US006463625B2

(12) United States Patent
Mittag

(10) Patent No.: US 6,463,625 B2
(45) Date of Patent: Oct. 15, 2002

(54) DOOR TRUCK WITH A ONE PIECE FRAME AND LOW FRICTION WHEELS

(75) Inventor: Douglas C. Mittag, Bollingbrook, IL (US)

(73) Assignee: Richards-Wilcox, Inc., Aurora, IL (US)

( * ) Notice: Subject to any disclaimer, the term of this patent is extended or adjusted under 35 U.S.C. 154(b) by 64 days.

(21) Appl. No.: 09/740,020

(22) Filed: Dec. 20, 2000

(65) Prior Publication Data

US 2002/0073506 A1 Jun. 20, 2002

(51) Int. Cl.[7] ..... E05D 15/08
(52) U.S. Cl. ..... 16/97; 16/105; 16/106
(58) Field of Search ..... 16/97, 98, 105, 16/106, 107; 427/430.1, 431, 433, 250, 436, 437, 438, 443.1

(56) References Cited

U.S. PATENT DOCUMENTS 670,640 A * 3/1901 Newell ..... 16/98
1,198,252 A * 9/1916 Marx ..... 16/98
1,931,796 A * 10/1933 Hoffman ..... 16/105
2,783,493 A * 3/1957 Gussack ..... 16/97
3,479,682 A * 11/1969 McNinch ..... 16/97
3,716,890 A * 2/1973 Benson ..... 16/105
3,757,384 A * 9/1973 Rusch ..... 16/97
5,070,575 A * 12/1991 Redman et al. ..... 16/105
5,599,646 A * 2/1997 Foley et al. ..... 427/430.1
6,209,171 B1 * 4/2001 Pelletier et al. ..... 16/97

OTHER PUBLICATIONS 31 rack Head Sections dated Jun. 1998.

* cited by examiner

*Primary Examiner*—Anthony Knight
*Assistant Examiner*—Michael Wayne White
(74) *Attorney, Agent, or Firm*—Schiff Hardin & Waite

(57) ABSTRACT

A door truck which has a one piece frame and plastic wheels for operation in an overhead track for supporting a door in which the wheels are mounted to the frame with barrel nuts and a threaded stud. The frame has a door supporting portion through which a pendant nut can be extended with its head mounted upwardly or downwardly so as to support a door.

24 Claims, 3 Drawing Sheets

96
98
34b
34
97
34c
97
99
34a 76
91
73
92
12
9
13
11
27
33
33a
27a
27b
18
10
6
41
28
28a
28b
36
36a
33b
16
38
43
34a
20
14
17
34
21
22
39
44
42
29a
5
83
36b
26
48
31a
52
49
29
77
29b
31
31b
34c
76
47
46
51
37c
24
37
37a
23
82
79
37b
78
74
81
67
64
73
60
66
61
62

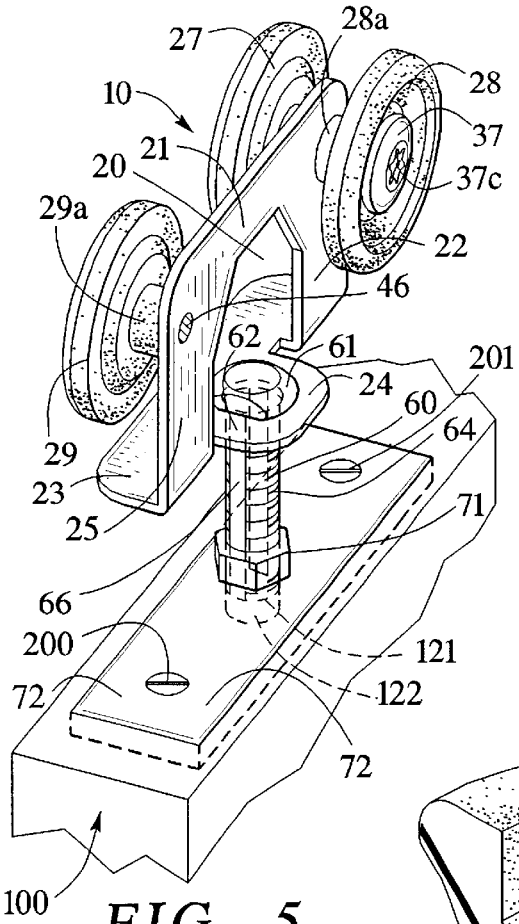
FIG. 5
FIG. 6
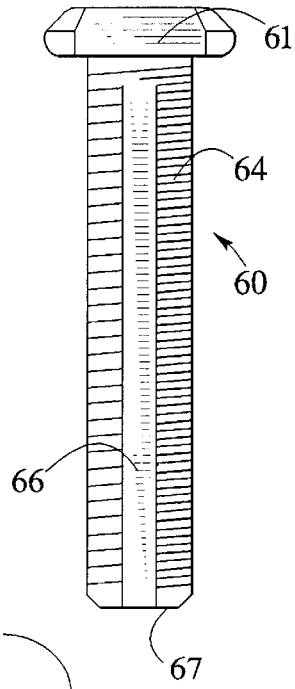
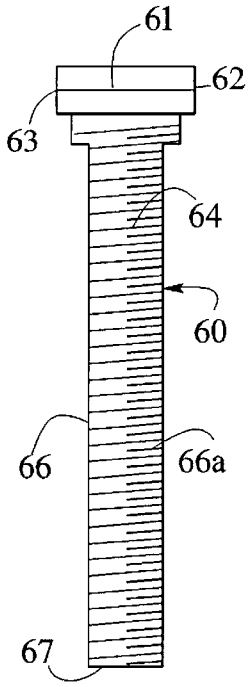
FIG. 7
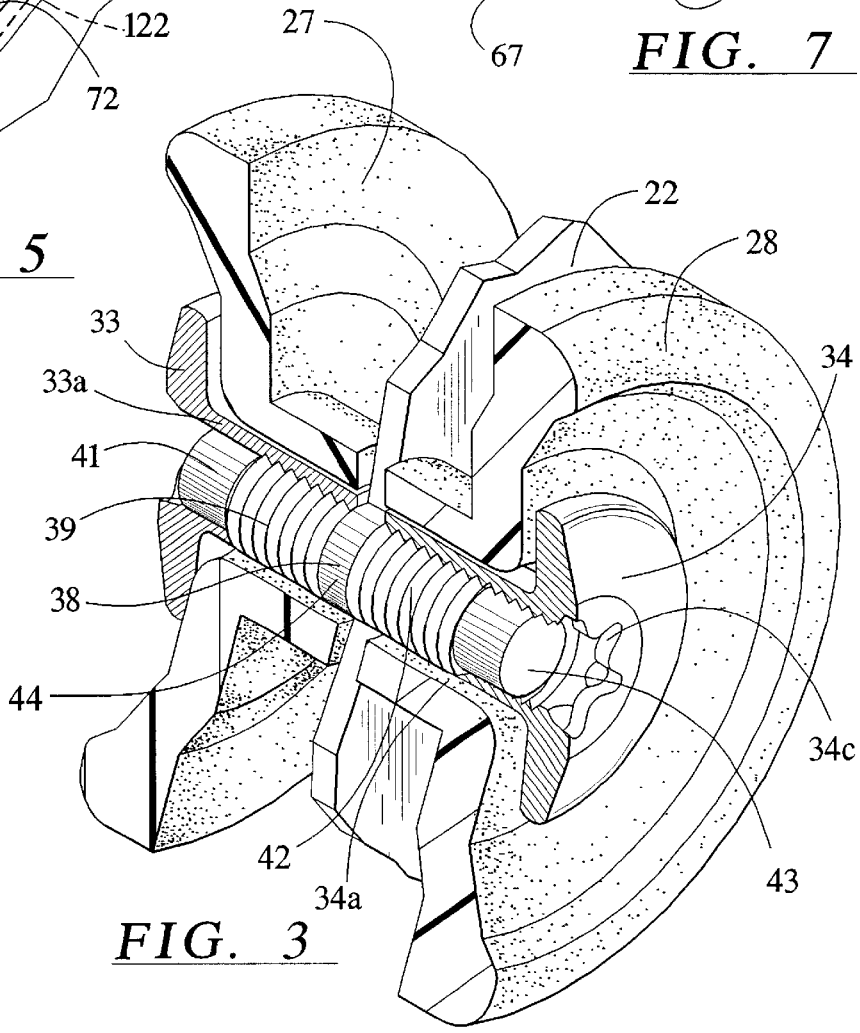
FIG. 3

DOOR TRUCK WITH A ONE PIECE FRAME AND LOW FRICTION WHEELS

BACKGROUND OF THE INVENTION

The present invention relates to a door truck. It is known in the prior art to use metal wheels in a door truck which transports a sliding door hanging beneath the door truck. The use of a metal wheels causes high wear on a track which shortens the life of the track. Prior art door trucks use pendants which extend from the truck and are difficult to adjust.

SUMMARY OF THE INVENTION

It is an object of the present invention to provide a door truck which has plastic wheels and which includes a one piece frame designed to support the pendant below the track.

It is another object of the invention to provide an improved door truck which has wheels made of plastic which run quieter and eliminate the need for separate bearings for each wheel. The plastic wheels are also softer then steel wheels and extend the life of the door track.

It is a further object of the present invention to provide an improved pendant in a door truck which can be adjusted outside of the confines of the track. The pendant has flat sides on the head and also flat sides on the threaded body so that wrenches can be used to turn or hold the pendant so that it can be installed either with the head up or with the head down.

It is an object of the present invention to provide an improved door truck which can be simply assembled by merely screwing barrel nuts on a threaded stud. This eliminates the need for expensive processes such as welding, staking or riveting which are needed with prior art designs.

A door truck according to the invention has a one piece frame and has four wheels made of Acetal or similar plastic which allow the truck to operate quieter and eliminates the need for separate bearings for the wheels. The plastic wheels are also softer than steel which is used in prior art trucks and extend the life of the track.

The invention utilizes one barrel nut for each wheel. There are four wheels in each door truck. The barrel nuts pass through the plastic wheels and are connected together by a threaded stud that has no threads on the leading edges so that they will slip into the barrel nuts and position the parts for ease of assembly. The center of the stud is not threaded which causes the stud to center itself when the nuts are tightened. Other designs such as knurled threads could be used at the center to cause the stud to center itself. An alternative to two barrel nuts and a threaded stud is to use a barrel nut with an extended male threaded end which fits into the threaded interior of a second barrel nut.

Since in the present invention it is not necessary to weld or heat the frame during assembly, the parts can be plated, as for example, by zinc plating before assembly. In the prior art devices, if the frame were plated before assembly, welding which is required in such prior art devices would destroy the corrosion protection since the zinc or other plating burns off.

The present invention provides a design of a door truck which allows flexibility during installation because the pendant is arranged to fit the needs of a particular door.

The pendant may be installed with the threads down so that the threads are accessible below the track rather than in the track where they are not accessible. When installed in this manner, the pendant can be turned to adjust the height of the door by screwing it in and out of a threaded hole in the top of the door. The pendant may also be installed with the threads up, and the head of the pendant then holds the door. Nuts at the top can then be turned to adjust the height of the door. Flat sides on the pendant are used to keep the pendant from turning while the nuts are turned. An additional feature is that the top end of the pendant can project up into the track which allows the top of the door to be very close to the bottom of the track.

Other objects, features and advantages of the invention will become apparent from the following description and claims when read in view of the drawings in which:

BRIEF DESCRIPTION OF THE DRAWINGS

FIG. 3 is an enlarged cut-away view showing the construction of the wheels and the barrel nuts and stud;

FIG. 5 is a perspective view of an alternate embodiment illustrating the door truck with the pendant screw extending downwardly from the frame;

FIG. 6 illustrates the pendant screw in a side view;

FIG. 7 illustrates the pendant screw in a front view; and

DESCRIPTION OF THE PREFERRED EMBODIMENTS

Figure 1:
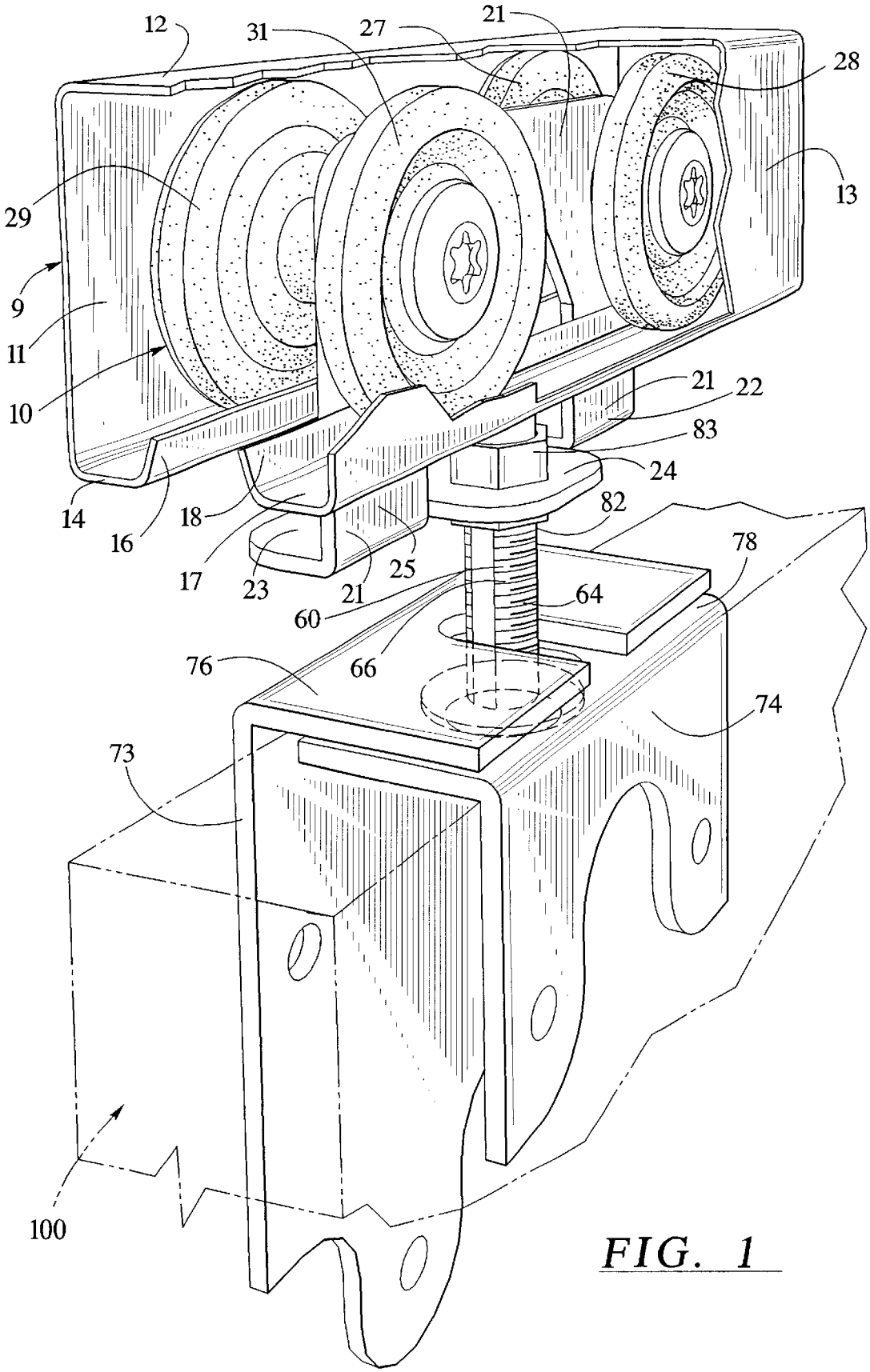
FIG. 1 is a partially cut-away perspective view illustrating the door truck of the invention with a pendant screw extending upwardly.
Figures 2, 4, 8:
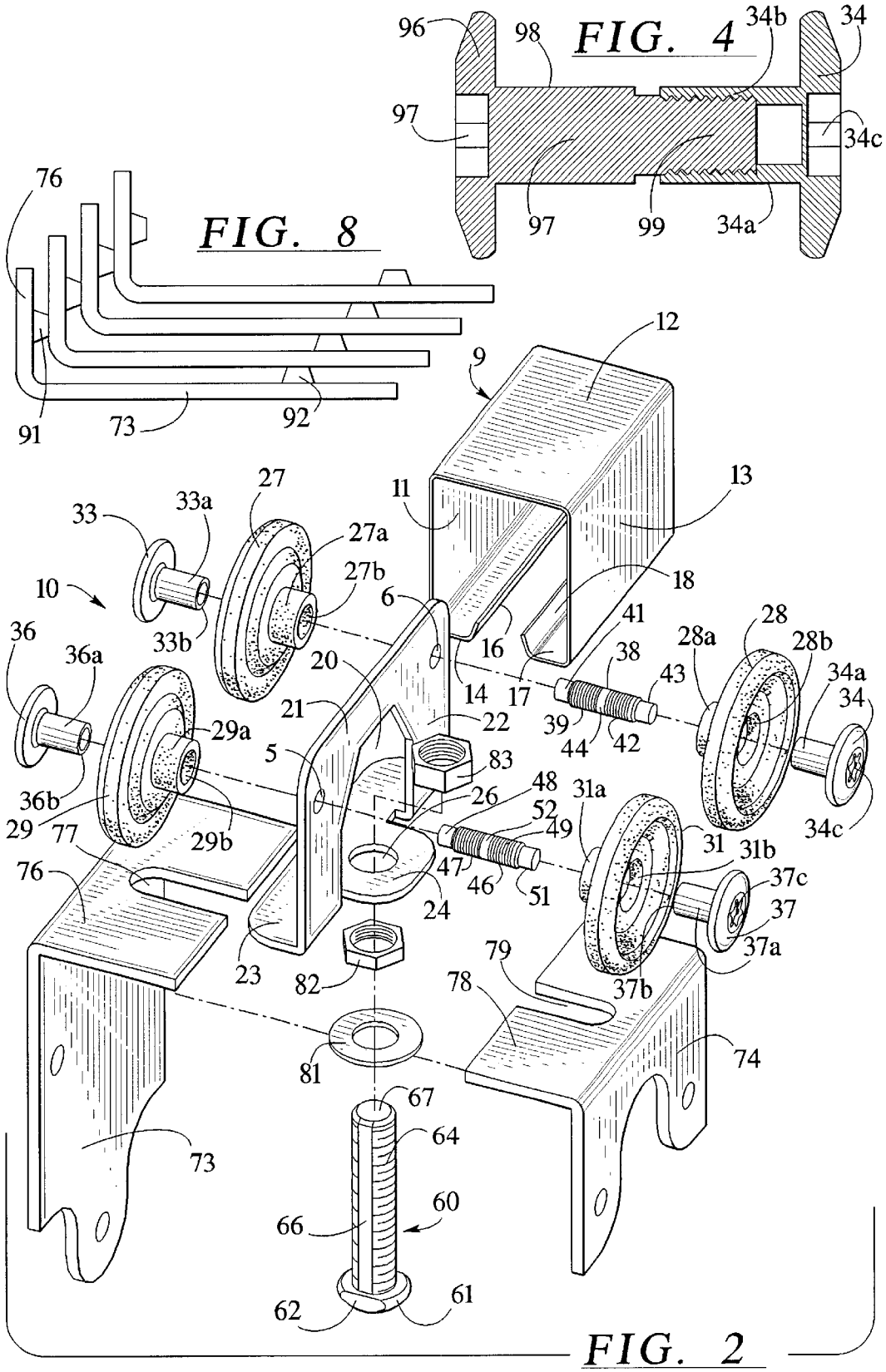
FIG. 2 is an exploded view illustrating the door truck of the invention.
FIG. 4 illustrates a modification of the wheel supporting structure.
FIG. 8 illustrates a number of frame members of the door truck for plating in a stacked position.

The figures illustrate a door truck 10 for supporting a door 100 as shown in FIG. 1. The door truck 10 moves in a rail track 9 which has vertically extending sides 11 and 13 connected by a top 12. The lower edge of side 11 has a wheel receiving trough formed of the bottom portion 14 and the upwardly extending portion 16. The downwardly extending side 13 is also formed with a wheel receiving trough which has a bottom portion 17 and upwardly extending side 18. As best shown in FIGS. 1 and 2, the door truck 10 includes a frame member 21 which has a downwardly extending portion 22 formed with an opening 20. A horizontal portion 23 is connected to the lower end of the vertical portion 22 and has a pendant supporting portion 24 through which an opening 26 is formed. Stud receiving holes 5 and 6 are formed through the upwardly extending portion 22 of the frame member 21. Four wheels 27, 28, 29 and 31 are attached to the frame member 21 by studs 38 and 46 and barrel nuts 33, 34, 36 and 37. The stud 38 has unthreaded guide portions 41 and 43 at opposite ends and has a center unthreaded portion 44 which separates threaded portions 39 and 42. The stud 46 is formed with unthreaded guide portions 48 and 51 at opposite ends thereof and threaded portions 47 and 49 which are separated by an unthreaded portion 52.

Wheel 27 is formed with the central opening 27*b* and has an extending hub 27*a*. Wheel 28 has a central opening 28*b* and an extending hub 28*a*. Wheel 29 has a central opening 29*b* and an extending hub 29*a*. Wheel 31 has a central opening 31*b* and an extending hub 31*a*.

The wheels 27, 28, 29 and 31 are mounted to the frame 21 as best shown in FIGS. 2 and 3. The barrel nut 33 is formed with an extending portion 33*a* which is formed with an internally threaded opening 33*b*. The extending portion 33*a* is passed through the opening 27*b* of wheel 27. The stud 38 is passed partially through the opening 6 of the frame 21 and the barrel nut 33 is threaded onto the threaded portion 39 of the stud 38. As shown in FIG. 4, the barrel nut 34 has an extending portion 34*a* and a central threaded opening 34*b* which is inserted through the central opening 28*b* of wheel 28 and threaded on the portion 42 of the stud 38. The heads of barrel nuts 33 and 34 are formed with shaped depressions such as 34*c* in barrel nut 34 to allow a tool to be used to tighten the barrel nuts 33 and 34 on the stud 38 so as to firmly attach the wheels 27 and 28 to the frame 21. Although one exemplary embodiment for the shape of the depression is shown, other shapes may be employed.

The barrel nut 36 has an extending portion 36*a* which has an internally threaded opening 36*b* which is inserted through a central opening 29*b* of barrel 29*a* of wheel 29. The stud 46 is passed through the opening 5 of the frame 21 and the barrel nut 36 is threaded onto the threaded portion 47 of the stud 46. The barrel nut 37 has an extending portion 37*a* formed with a central opening 37*b* which is passed through the opening 31 b of the wheel 31 and threaded onto the threaded portion 49 of the stud 46. The barrel nuts 33, 34, 36 and 37 are tightened by a suitable tool to securely attach the wheels 27, 28, 29 and 31 to the frame 21. It is to be noted that, as shown in FIG. 3, when the barrel nuts 33 and 34 have been tightened that the wheels 27 and 28 are free to rotate on portions 33*a* and 34*a* of barrel nuts 33 and 34.

FIG. 4 illustrates a modification which can be used instead of two barrel nuts. The barrel nut 34 is joined with a screw 97 that has a head 96 and an unthreaded extending portion 98 which is connected to a threaded portion 99 that has a smaller diameter formed with threads which are receivable in the opening 34*b* of the barrel nut 34.

As shown in FIGS. 1 and 2, a door 100 is attached to the door truck 10 by a pendant screw 60 which extends upwardly through the opening 26 of the frame 21.

In a first embodiment as shown in FIGS. 1 and 2, the bolt 60 may be mounted with its head 61 underneath and wherein the bolt extends upwardly from the door 100. The frame members 73 and 74 and a nut 83 are threaded onto the upper end of the threaded portion 64 of the bolt 60 above the frame member 24 to support the door. A lock nut 82 is threadedly mounted on the bolt 60 below the frame portion 24 so as to lock the bolt in a adjusted position. The frame members 73 and 74 attached to the door 100 have top portions 76 and 78 as best shown in FIG. 2 which are formed with grooves 77 and 79 through which the threaded portion 64 of screw 60 extends.

As shown in a second embodiment of FIG. 5, the portion 24 of the frame 21 extends below the track 9 and a pendant screw 60 can be mounted downwardly wherein the head 61 rests against the portion 24 and the threaded shaft 64 of the screw extends downwardly and is threadedly received by a threaded aperture 121 in a reinforcing plate 72 attached to the top of the door 100 with screws 200 and 201. A lock nut 71 may be threadedly received on the threaded shaft 60 as shown in FIG. 5. The plate is in-laid into a top of the door and a cavity 122 is provided beneath the plate 72 as clearance for the end of the screw 60.

The screw 60 is formed with a flatted head 61 having flat portion 62 and 63 as shown in FIG. 7 and is formed with flatted portions on the threaded shaft 64. These shaft flatted portions are shown as flatted portions 66 and 66*a* in FIGS. 6 and 7. The flatted head portions 62 and 63 and the flatted portions 66 and 66*a* allow the head and/or the shaft 64 of the bolt 60 to be held or turned as desired with a suitable wrench to adjust the height of the door relative to the truck.

The frame 21 of the present invention may be plated prior to assembly since there is no welding or heating of the frame during assembly and for this purpose small extending portions 91 and 92 are formed as shown in FIG. 8 on the members 73 or member 74 or the frame member 21. These portions 91 and 92 space the parts during plating so that they will not nest together and allow plating compound to freely flow between adjacent components while they are being plated. This assures that plating will occur on both surfaces of the parts.

It is seen that this invention provides an improved door truck which has a one piece frame which allows the truck to be easily manufactured and assembled and which has plastic wheels that provide less wear on the track. The truck can be assembled much quicker than the prior art devices and is less expensive. The invention requires no separate plastic bearings and is not subject to the load carrying limitations of ball bearing designs of the prior art. The load carrying limitations of the prior art is due to the steel wheel causing damage to the track. The plastic wheel, being softer does not damage the track.

The invention also provides for an easily adjustable pendant screw which can be mounted with threads up or down as shown in the drawings.

Although the invention has been described with respect to preferred embodiments, it is not to be so limited as changes and modifications can be made therein which are within the full intended scope of the invention as defined by the appended claims.

I claim as my invention:

1. A door truck for holding a door and which is moveable in and along an overhead track, comprising:

a frame member with a vertical portion through which at least one opening is formed;

first and second plastic wheels formed with supporting openings;

an axle structure formed of a threaded stud threadedly receiving first and second barrel nuts which passes through the supporting openings of said wheels; and said first and second barrel nuts providing respective non-rotating bearing surfaces around which the wheels rotate, and for retaining and positioning the wheels relative to said frame opening through which the threaded stud passes.

2. The door truck according to claim 1 including third and fourth plastic wheels formed with supporting openings, another axle structure formed of a threaded stud and first and second barrel nuts which passes through the supporting openings of the third and fourth wheels, and said another axle structure mounting said third and fourth wheels on opposite sides of said frame member at another frame opening.

3. The door truck according to claim 1 wherein said threaded stud is formed with guide portions on its opposite ends.

4. The door truck according to claim 1 wherein said threaded stud has a center portion which is not threaded.

5.The door truck according to claim 1 wherein said first and second wheels are formed with hubs.

6. The door truck according to claim 1 wherein said frame member is formed with a door supporting portion below said track which is formed with an opening and a door holding element attaching said frame member to said door.

7. The door truck according to claim 6 wherein said holding element comprises a bolt.

8. The door truck according to claim 7 wherein said bolt is formed with a flatted portion on its threaded shaft.

9. The door truck according to claim 7 wherein said bolt has a flat head.

10. The door truck according to claim 1 wherein the frame member has an L-shape with a bottom of the L having a flange with a hole in it which receives a bolt connecting the frame member to the door.

11.The door truck according to claim 10 Wherein the bolt has a head and the head is positioned against the flange with a threaded portion of the bolt extending downwardly to a mounting structure on the door.

12. The door truck according to claim 10 wherein the mounting element comprises a bolt having a head and wherein the head of the bolt is attached by a mounting structure at the door and a threaded portion of the bolt passes through the aperture of the flange and is retained by a nut.

13. The door truck according to claim 1 wherein the frame member has projections to allow nesting of the frame member during plating of the frame member.

14. The door truck according to claim 1 wherein the track comprises a channel having a wheel receiving trough at a bottom of each of parallel extending vertical sides.

15. A door truck for holding a door and which is moveable in and along an overhead track, comprising:

a frame member with a vertical portion through which at least one opening is formed;

first and second plastic wheels formed with supporting openings;

an axle structure formed of a threaded stud and at least first and second holding members which pass through the respective supporting openings of said wheels; and said first and second holding members being connected to each other via said threaded stud through said at least one frame opening to mount said first and second wheels on opposite sides of said frame member, said first and second holding members each having a head and an extending portion as a bearing surface directly supporting said plastic wheels which rotate therearound, and said first and second holding members captivating and positioning said wheels relative to said vertical portion.

16. A door truck for holding a door and which is moveable in and along an overhead track, comprising:

a frame member with a vertical portion through which two openings are formed;

first, second, third, and fourth plastic wheels formed with supporting openings;

first and second axle structures formed of at least a threaded stud and first and second holding members which pass through the supporting openings of said wheels and having non-rotating cylindrical extending portions which are in direct rotational bearing contact with plastic portions of said wheels; and said first and second holding members of each axle structure being threadedly joined to each other with said threaded stud through said respective frame openings to mount said first and third wheels on one side of said frame member, and said second and fourth wheels on an opposite side of said frame member, said first and second holding member cylindrical extending portion having an inner surface directly facing said vertical portion and an outer head captivating said wheels.

17. A method for assembling a door truck for holding a door, said door truck being designed for movement along an overhead track beneath which the door hangs, comprising the steps of:

stamping out a one-piece metal frame member having a vertical portion through which at least one opening is provided; and assembling first and second plastic wheels to the frame member by threading at least a first member onto one end of a threaded stud and a second member onto an opposite end of the threaded stud to form an axle structure, the first and second members providing non-rotating bearing surfaces around which the wheels rotate and which together with a head captivate said wheels for mounting the plastic wheels at the opening.

18. The method according to claim 17 including the step of providing an additional opening mounting another pair of wheels at the additional opening by threading at least first and second members onto another threaded stud is to form another axle.

19. The method according to claim 17 including the step of providing a bolt, providing a flange on the frame member, threading the bolt through the opening in the flange member and attaching the door to one end of the bolt.

20. The method according to claim 19 including the step of providing a head of the bolt underneath mounting elements connected to the door and threading a nut over a threaded end of the bolt above the flange, and adjusting a height of the door relative to the track by holding the nut and turning the bolt by use of flat portions on the bolt.

21. The method according to claim 19 including the step of providing the head of the bolt above the flange, and then providing flats on the threaded portion of the bolt and using the flats to turn the bolt to adjust a distance of the door from the frame member by screwing the threaded portion of the bolt into receiving threads mounted to the door.

22. The method according to claim 17 including the step of assembling the axle by use of first and second barrel nuts as said first and second members received at opposite ends of said stud which passes through the opening of the frame by screwing the barrel nuts onto threads of the stud.

23. The method according to claim 17 including the step of plating the frame member prior to mounting the wheels.

24. The method according to claim 23 including the step of plating the frame member by stacking the frame members by use of projections on the frame members so as to keep them spaced during the plating.

* * * * *